US006075505A

United States Patent [19]

Shiba et al.

[11] Patent Number: 6,075,505

[45] **Date of Patent: *Jun. 13, 2000**

[54] ACTIVE MATRIX LIQUID CRYSTAL DISPLAY

[75] Inventors: Hiroshi Shiba; Koichi Koga; Kouichi Nishimura, all of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,712

[22] Filed: Sep. 2, 1997

[30] Foreign Application Priority Data

Aug. 30, 1996 [JP] Japan ..... 8-230595

[51] Int. Cl.[7] ..... G09G 3/36

[52] U.S. Cl. ..... 345/87; 345/92; 345/205; 345/206

[58] Field of Search ..... 345/87, 92, 205, 345/206, 97

[56] References Cited

U.S. PATENT DOCUMENTS

| | | | |
|---|---|---|---|
| 5,253,091 | 10/1993 | Kimura et al. | 345/87 |
| 5,745,087 | 4/1998 | Tomiyoshi et al. | 345/87 |
| 5,774,100 | 6/1998 | Aoki et al. | 345/87 |
| 5,793,344 | 8/1998 | Koyama | 345/87 |
| 5,831,709 | 11/1998 | Song | 345/92 |
| 5,894,295 | 4/1999 | Shimada et al. | 345/92 |
| 5,923,311 | 7/1999 | Edwards | 345/92 |

FOREIGN PATENT DOCUMENTS

| | | |
|---|---|---|
| 58-203486 | 11/1983 | Japan . |
| 3-38689 | 2/1991 | Japan . |
| 5-265045 | 10/1993 | Japan . |
| 10-142578 | 5/1998 | Japan . |

*Primary Examiner*—Richard A. Hjerpe
*Assistant Examiner*—Kimnhung Nguyen
*Attorney, Agent, or Firm*—Young & Thompson

[57] ABSTRACT

An active matrix liquid crystal display is provided, wherein adjacent two odd and even pixels are commonly connected to a single signal line, and two scanning lines are allocated to one horizontal display line, two switching elements of the adjacent two odd and even pixels are respectively connected to different ones of the two scanning lines and further the odd and even display lines are opposite to each other in connections of the display lines and the switching elements.

3 Claims, 14 Drawing Sheets

FIG. 4 PRIOR ART

Polarity of display screen

| | | | | | | | | | | | |
|---|---|---|---|---|---|---|---|---|---|---|---|
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |
| + | − | + | − | + | − | + | − | + | − | + | − |
| − | + | − | + | − | + | − | + | − | + | − | + |

FIG. 7 PRIOR ART

Polarity of display screen

| | | | | | | | | | | | |
|---|---|---|---|---|---|---|---|---|---|---|---|
| + | − | − | + | + | − | − | + | + | − | − | + |
| + | − | − | + | + | − | − | + | + | − | − | + |
| + | − | − | + | + | − | − | + | + | − | − | + |
| + | − | − | + | + | − | − | + | + | − | − | + |
| + | − | − | + | + | − | − | + | + | − | − | + |
| + | − | − | + | + | − | − | + | + | − | − | + |
| + | − | − | + | + | − | − | + | + | − | − | + |
| + | − | − | + | + | − | − | + | + | − | − | + |

FIG. 11

Polarity of display screen

| | | | | | | | | | | | |
|---|---|---|---|---|---|---|---|---|---|---|---|
| + | − | − | + | + | − | − | + | + | − | − | + |
| − | + | + | − | − | + | + | − | − | + | + | − |
| + | − | − | + | + | − | − | + | + | − | − | + |
| − | + | + | − | − | + | + | − | − | + | + | − |
| + | − | − | + | + | − | − | + | + | − | − | + |
| − | + | + | − | − | + | + | − | − | + | + | − |
| + | − | − | + | + | − | − | + | + | − | − | + |
| − | + | + | − | − | + | + | − | − | + | + | − |

ACTIVE MATRIX LIQUID CRYSTAL DISPLAY

BACKGROUND OF THE INVENTION

The present invention relates to a liquid crystal display, and more particularly to an active matrix liquid crystal display with a reduced number of driver circuits for signal lines whilst obtaining an improved display quality.

In recent years, liquid crystal displays using thin film transistors have been widely used as a display of various electronic devices particularly a note-type personal computer. Reduction in the price of the various electronic devices particularly the note-type personal computer has been required. In order to realize the required reduction in the price of the various electronic devices particularly the note-type personal computer, it is essential to reduce the cost of the driver IC use as a driver circuit for driving the signal lines in the liquid crystal display panel. The reason why the driver IC is expensive is the high cost of the individual driver IC due to its high performance and a large number of the driver ICs to be used. In this circumstance, it was proposed to reduce the number of the driver ICs to be used. In the Japanese laid-open patent publications Nos. 3-38689, 5-26504 and 6-148680, it is disclosed that adjacent two pixels commonly use a signal line extending between the adjacent two pixels so as to reduce by half the signal line driver ICs.

The following descriptions will focus on the technique of reducing by half the number of the driver ICs for the signal lines. FIG. 1 is a block diagram illustrative of a typical and conventional active matrix liquid crystal display. The active matrix liquid crystal display has a liquid crystal display panel 1 for displaying images. A signal line driver circuit 2 is provided for driving signal lines of the liquid crystal display panel 1. A scanning driver circuit 3 is provided for driving scanning lines of the liquid crystal display panel 1. A timing generator circuit 5 is provided which is connected to both the signal line driver circuit 2 and the scanning driver circuit 3 for supply control signals to both the signal line driver circuit 2 and the scanning driver circuit 3 respectively. The timing generator circuit receives a vertical synchronizing signal "Vsync", a horizontal synchronizing signal "Hsync" and a dot clock signals "CLK" and generates various control signals. A data processing circuit 4 is further provided which is connected to the timing generator circuit 5 for fetching control signal. The data processing circuit 4 is also connected to the signal line driver circuit 2 and also adopted to receive data and process the received data for supplying the processed data to the signal line driver circuit 2 as the data interface.

FIG. 2 is a circuit diagram illustrative of connections among scanning lines, signal lines, thin film transistors, pixel electrodes and a common electrode. The scanning lines G1 to Gm are provided which extend in row direction and in parallel to each other. The signal lines S1 to Sn are also provided which extend in column direction vertical to the row direction and in parallel to each other. The scanning lines G1 to Gm and the signal lines S1 to Sn form matrixes. Display pixels are aligned in matrix. The display pixels are connected through thin film transistors, TFT to the signal lines. Gates of the thin film transistors TFT are connected to the scanning lines. Source electrodes of the thin film transistors TFT are also connected to the display pixels. Drain electrodes of the thin film transistors TFT are also connected to the signal lines S1 to Sn. The display pixels and the common electrode form capacitances.

FIG. 3 is a driving timing chart of the conventional active matrix liquid crystal display. Data are inputted into the data processing circuit 4 and the processed signals are then inputted into the signal line driver circuit 2. Notwithstanding, in view of the one horizontal period 1H, data may be considered to be inputted into the signal line driver circuit 2 at almost the same timing as the timing of the data input into the data processing circuit 4. The data for the one horizontal period 1H are sequentially accumulated in the signal line driver circuit 2 until the full accumulation could be achieved for subsequent one time outputs of the data to individual output terminals of the signal line driver circuit 2. When data to the first line are outputted thereto, the scanning line driver circuit 3 outputs the output signal G1 which is capable of turning the thin film transistor ON. After the output of the data to the first line has been completed, the output signal G1 from the scanning line driver circuit 3 is changed into the OFF voltage which is capable of turning the thin film transistor OFF. Concurrently, data for the second line are about to be outputted whereby the output signal G2 from the scanning line driver circuit 3 is changed into the ON voltage which is capable of turning the thin film transistor ON. In synchronous to the output of the line data, the ON voltage is shifted over the scanning lines. In this time, if the common electrode remains constant in voltage level, the ON voltage is about 20 V whilst the OFF voltage is about −7 V. When the scanning line is in ON, the TFT is conductive whereby a potential of the signal line is written into the pixel. Data are sequentially written into the display pixels for individual horizontal lines so that display patterns for one frame are formed in the one vertical period. The polarity of the signal data is inverted for every outputs or every lines. Output of the signal line driver circuit 2 are opposite to each other between adjacent two signal lines for dot inversion. For one time data writing or one line data writing, the adjacent outputs are opposite to each other in polarity, for which reason potential of the common electrode is free from any variation. Images written in the one frame is as illustrated in FIG. 4, fore which reason even if the positive and negative writings are different from each other, then approximate uniformity can be obtained for good display performance.

In order to reduce the cost of the liquid crystal display, it was proposed to reduce by half the number of the signal line drifter ICs. The adjacent two pixels commonly use the signal line and thus the number of the outputs of the signal line driver circuits is reduced by half The size of the circuits is also reduced by half By contrast, the number of the scanning lines is increased by double. The size of the circuit is also double. The scanning line driver circuit is more simple in circuit configuration than the signal line driver circuit, for which reason the scanning line driver circuit is lower in cost than the signal line driver circuit.

FIG. 5 is a circuit diagram illustrative of a second conventional liquid crystal display. The adjacent two pixels commonly use the signal line extending between the adjacent two pixels. The pixel is connected through the thin film transistor into the signal line. For a single horizontal display line, two scanning lines are allocated. The thin film transistors are alternately connected through those gates to the different and adjacent scanning lines.

FIG. 6 is a timing chart of the second conventional liquid crystal display. Data are inputted into the data processing circuits and are divided by the data processing circuits into odd and even data groups A and B so that data divided into the odd and even data groups A and B are output in a half horizontal period. The data processing circuits need line memories. In accordance with the output of the signal line driver circuit, the ON voltage of the thin film transistor is shifted over the scanning lines sequentially. The odd and even data are alternately written. The one time writing time-period is half of the normal one since the odd and even data are sequentially written.

By the way, adjacent two outputs are opposite in polarity to each other. If as illustrated in FIG. 6 the output is inverted in polarity for every times, then the polarity is changed for every two columns as illustrated in FIG. 7. If the negative and positive polarity writings are different from each other, then column stripes appear on the display. In order to settle this problem, it is effective to modify the signal or scanning line driver circuits. For example, all of the outputs from the signal line driver circuits have the same polarity and the polarity is inverted for every two outputs so that the dot inversion display screen illustrated in FIG. 4 can be obtained.

Even if all of the outputs from the signal line driver circuits have the same polarity, then a unidirectional current flows toward the common electrode and a voltage drop is caused whereby the potential of the common electrode is frictional. This provides an influence to the display quality. Also if the output form the signal line driver circuit is inverted for every one output and the ON voltage shift over the scanning line is alternatively carried out, then the two times ON voltage shifts form the dot inversion display as illustrated in FIG. 4 can be obtained. In this case, however, the data processing in correspondence to the scanning, line driving operations is required, for which reason the frame memory is also required. The scanning line driver circuit is not so simple rather complicated. As a result, the cost of the display is increased. Of course, the signal lines are driven in the same polarity, for which reason the above described influences are problem.

On the other hand, in view of the practice, the signal line driving ability and the price of the chip depending upon the chip area, it is important issue whether the polarity inversion may respond only for every one output or for every two or more outputs. Recently developed liquid crystal display has a large scale screen of 12 inches or more and has a high solution XGA or more. This means that the one horizontal period is shorten. This means that the signal writing time period makes large the load of the signal line driver circuit and the resistance and capacitance of the signal line. For example, in case of SVGA, the one horizontal time period is about 27 microseconds. In case of XGA is about 20 microseconds. Notwithstanding, if the number of the signal lines is reduced by half, then it is required to write the data within a quarter. This means the driving ability is sufficient for driving the signal lines.

If in order to drive a large display screen and a high solution display at high quality, the dot inversion driving for the low voltage driver ICs are required. The low power consumption is also required. This means the dynamic range may be set up to the power voltage, for which reason the driver ICs are required so that the adjacent outputs are inverted in polarity and sufficient driving ability is possessed and further the dynamic range takes the power voltage. For that purpose, the amplifier as the output stage is optimally as illustrated in FIGS. 8A and 8B.

In view of the reduction in the cost, it is preferable that the adjacent outputs are opposite in polarity and both outputs are inverted for every one and further the ON voltage of the thin film transistor is shifted over the scanning lines. However, this type of the display panel is hard to carry out the dot inversion driving for the high quality display for the reasons as described above.

SUMMARY OF THE INVENTION

Accordingly, it is an object of the present invention to provide an active matrix liquid crystal display wherein the adjacent outputs are opposite in polarity and both outputs are inverted for every one and further the ON voltage of the thin film transistor is shifted over the scanning lines but the display panel is capable of carrying out the dot inversion driving or similar driving thereto for the high quality display for the reasons as described above.

The above and other objects, features and advantages of the present invention will be apparent from the following descriptions.

The present invention provides an active matrix liquid crystal display, wherein adjacent two odd and even pixels are commonly connected to a single signal line, and two scanning lines are allocated to one horizontal display line, two switching elements of the adjacent two odd and even pixels are respectively connected to different ones of the two scanning lines and further the odd and even display lines are opposite to each other in connections of the display lines and the switching elements.

The present invention provides an active matrix liquid crystal display, wherein adjacent two odd and even pixels arts commonly connected to a single signal line, and two scanning lines are allocated to one horizontal display line, for one signal line the switching elements of the odd display pixel are connected to one of the odd and even scanning lines whilst the switching elements of the odd display pixel are connected to one of the odd and even scanning lines and further the odd and even display lines are opposite to each other in connections of the display lines and the switching elements.

The present invention provides an active matrix liquid crystal display, wherein a predetermined number of odd signal lines are short-circuited to form a first group and also a predetermined number of even signal lines equal to the predetermined number of odd signal lines are short-circuited to form a second group and a predetermined number of the scanning lines equal to the predetermined number of odd signal lines are allocated to one horizontal display line, each switching element connected to the display pixel electrode to the signal lines, being short-circuited and further the odd and even display lines are opposite to each other in connections of the display lines and the switching elements.

BRIEF DESCRIPTIONS OF THE DRAWINGS

Preferred embodiments of the present invention will be described in detail with reference to the accompanying drawings.

FIG. 4 is a view illustrative of polarity of each pixels of the conventional active matrix liquid crystal display.

FIG. 7 is a view illustrative of polarity of each pixels of the conventional active matrix liquid crystal display.

FIG. 11 is a view illustrative of polarity of each pixels of a novel active matrix liquid crystal display in a first embodiment according to the present invention.

BRIEF DESCRIPTION OF THE PREFERRED EMBODIMENTS

Figure 1:
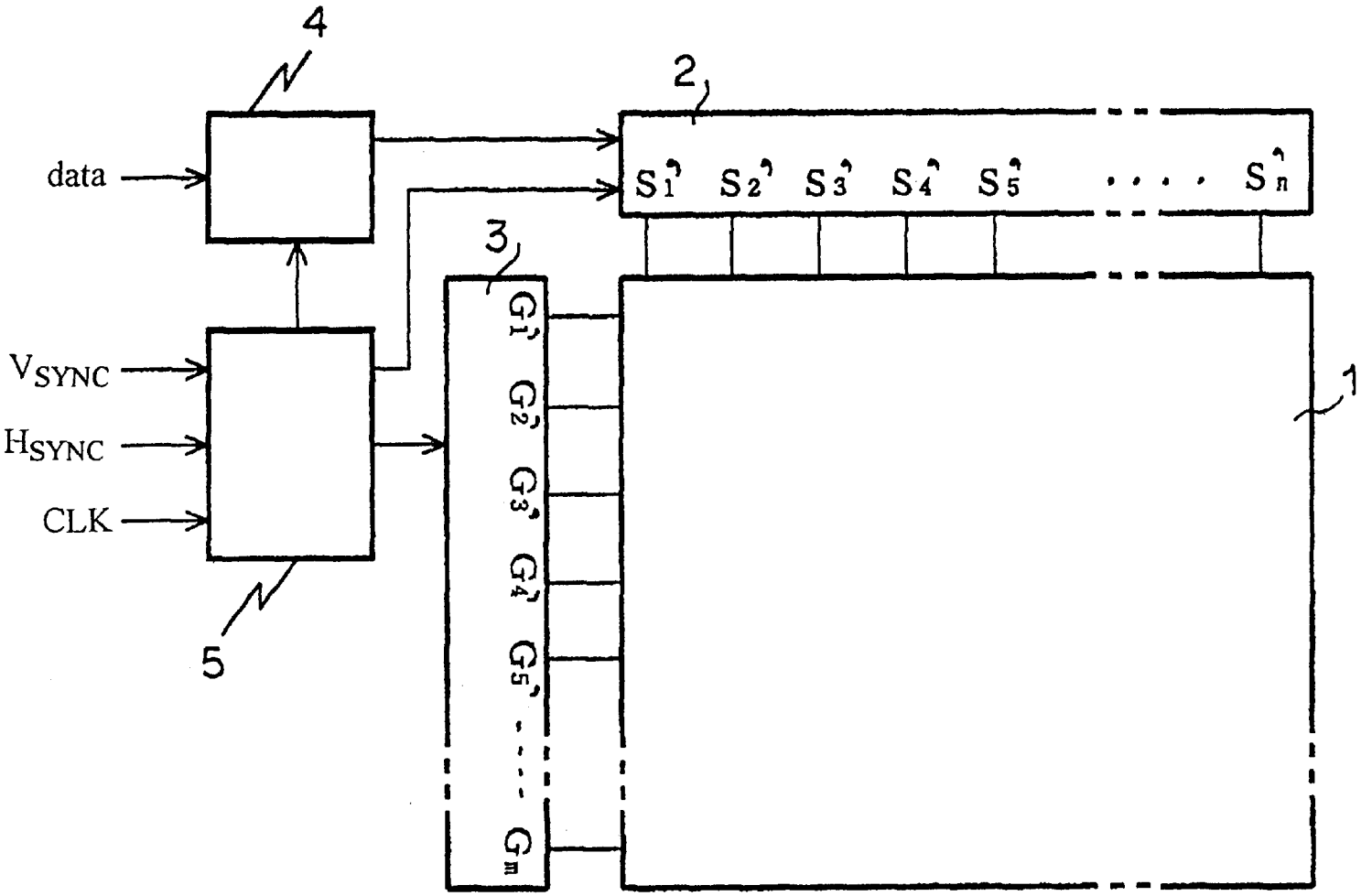
FIG. 1 PRIOR ART
FIG. 1 is a block diagram illustrative of a typical and conventional active matrix liquid crystal display.
Figure 2:
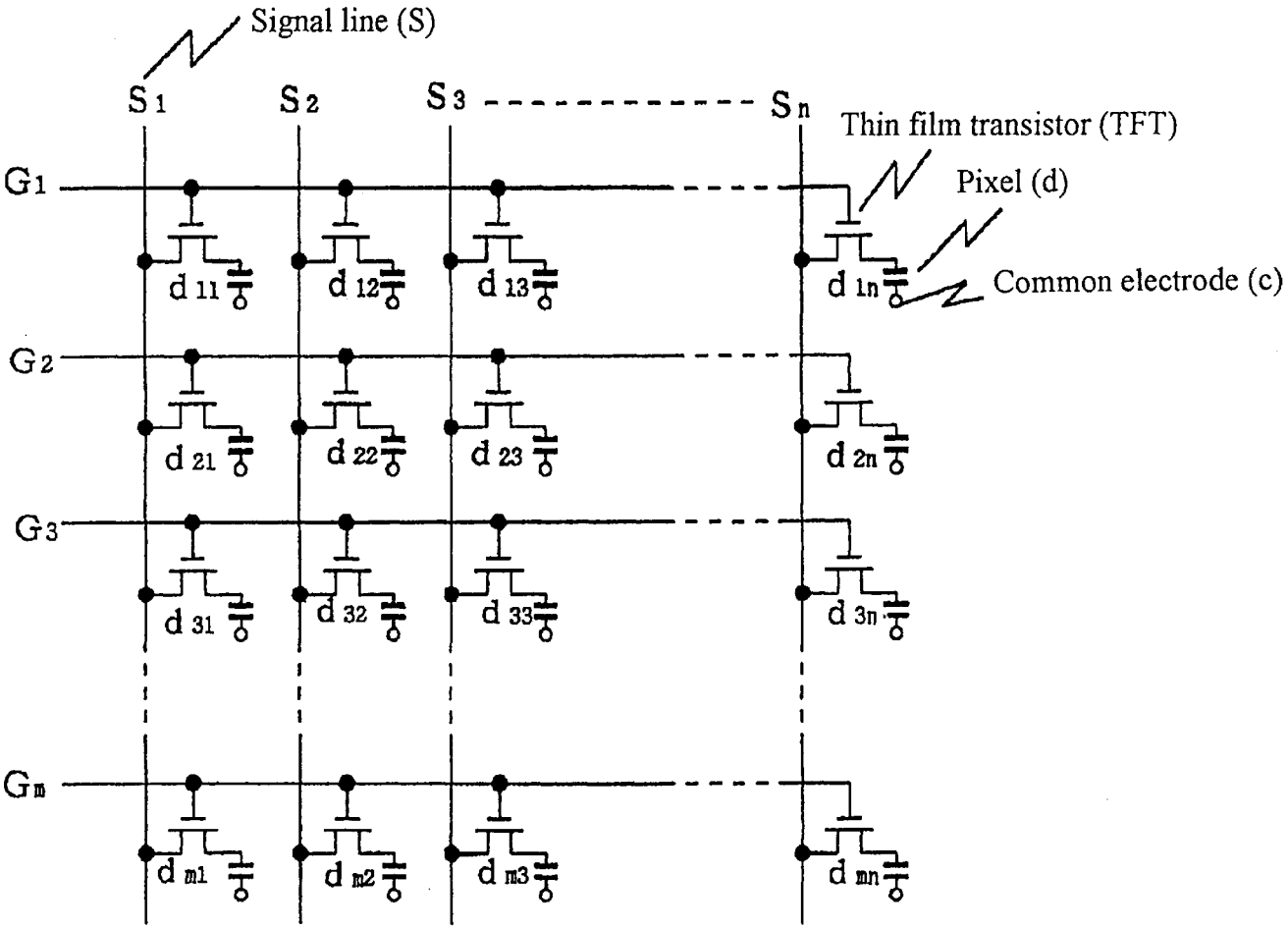
FIG. 2 PRIOR ART
FIG. 2 is a circuit diagram illustrative of connections among scanning lines, signal lines, thin film transistors, pixel electrodes and a common electrode.
Figure 3:
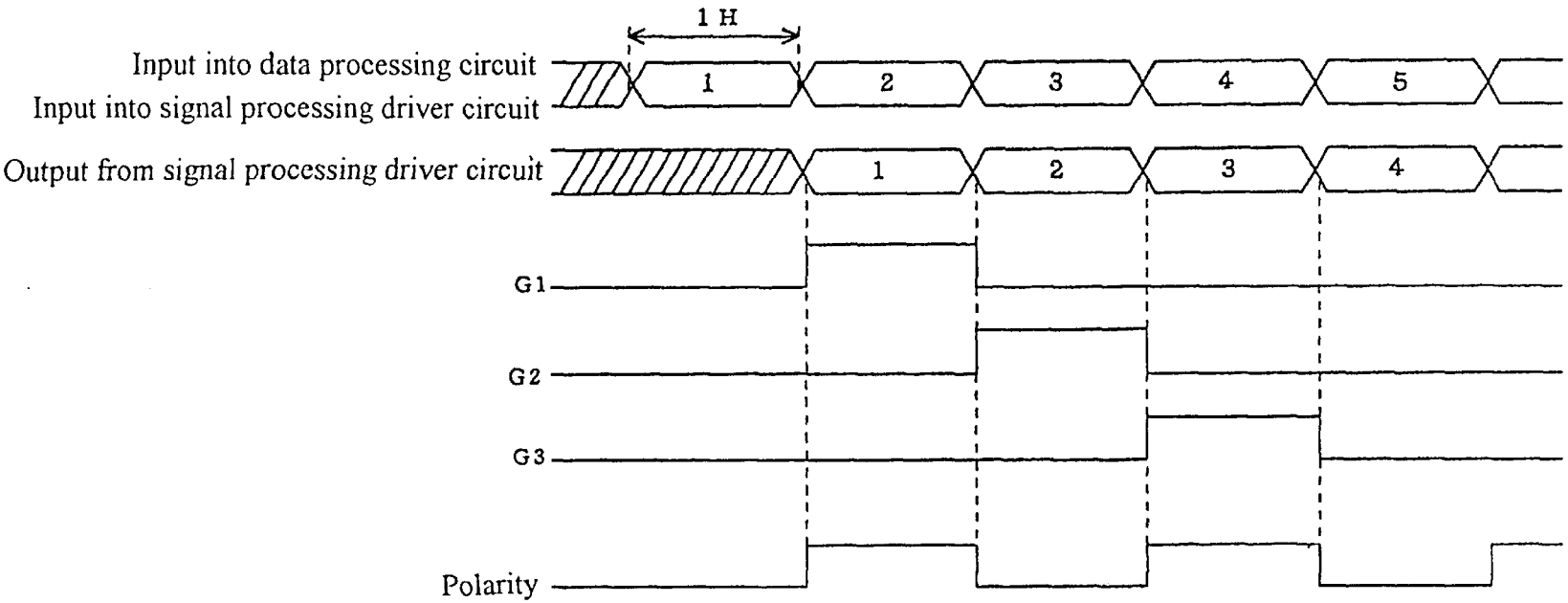
FIG. 3 PRIOR ART
FIG. 3 is a driving timing chart of the conventional active matrix liquid crystal display.
Figure 5:
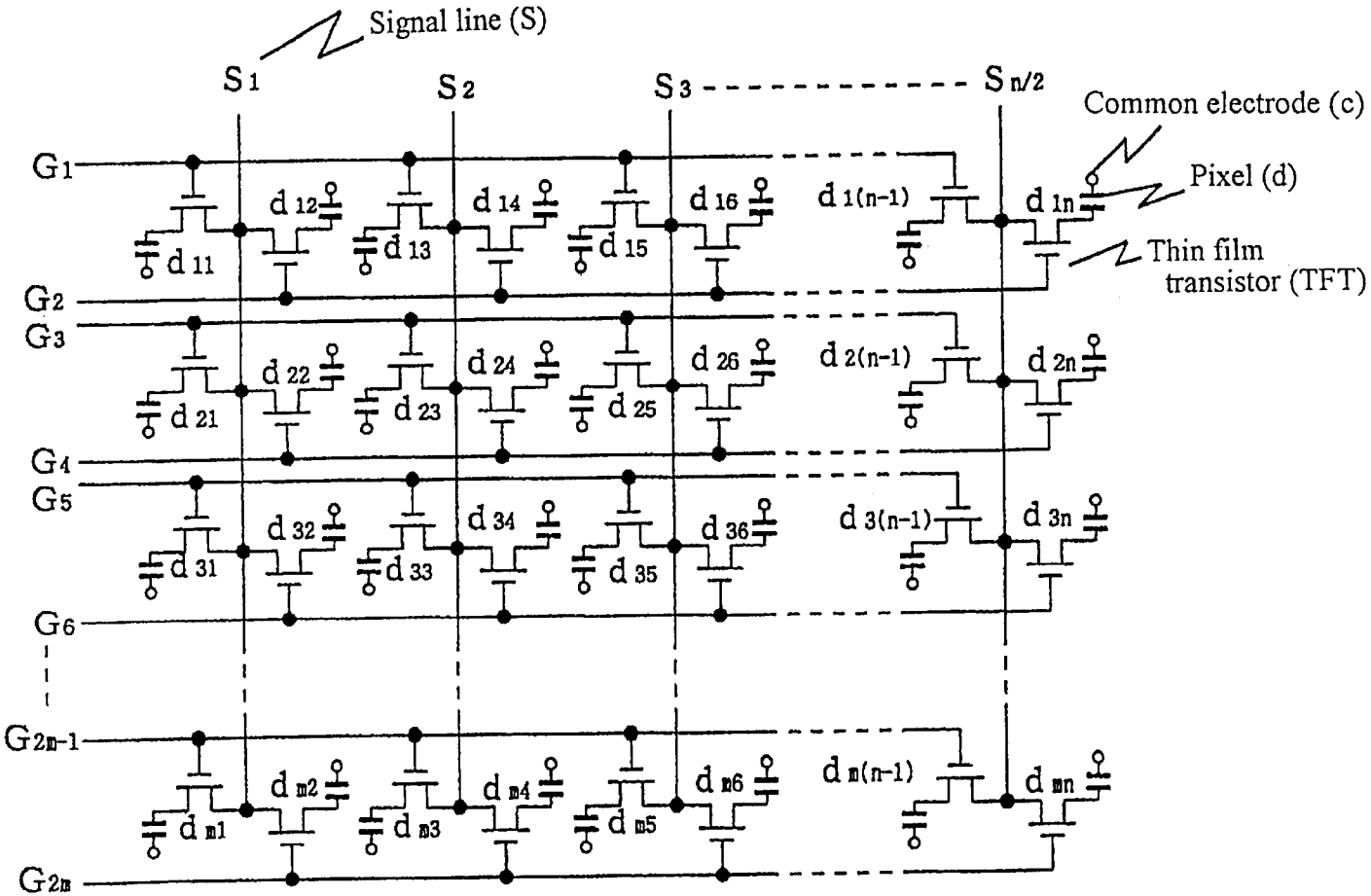
FIG. 5 PRIOR ART
FIG. 5 is a circuit diagram illustrative of a second conventional liquid crystal display.
Figure 6:
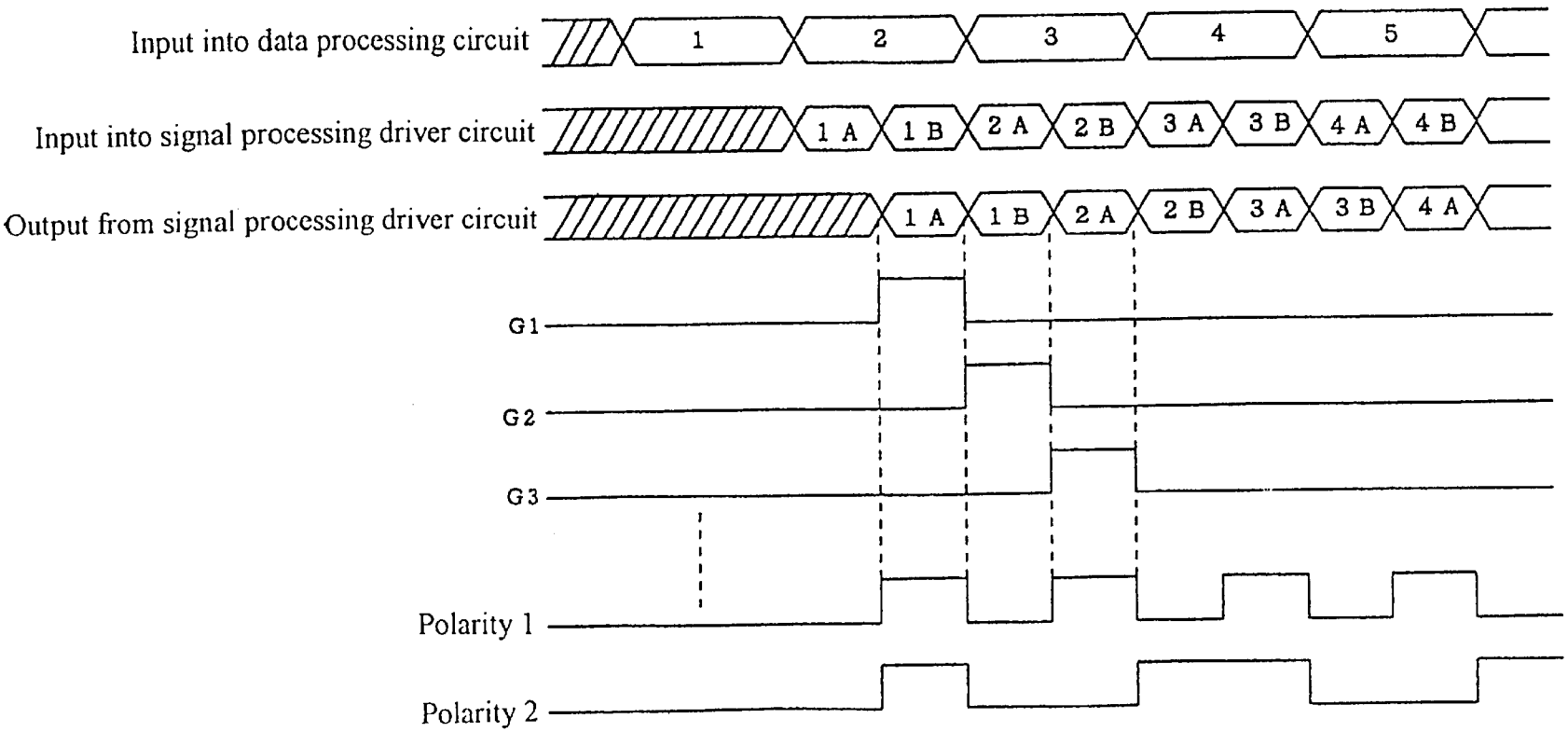
FIG. 6 PRIOR ART
FIG. 6 is a timing chart of the second conventional liquid crystal display.
Figure 8A:
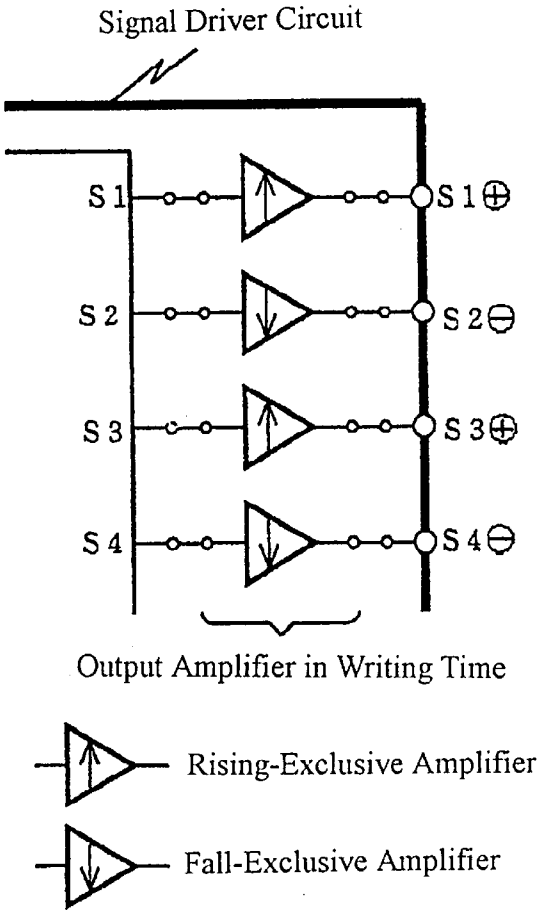
FIGS. 8A and 8B are circuit diagram illustrative of the output amplifier of the conventional active matrix liquid crystal display.
Figure 8B:
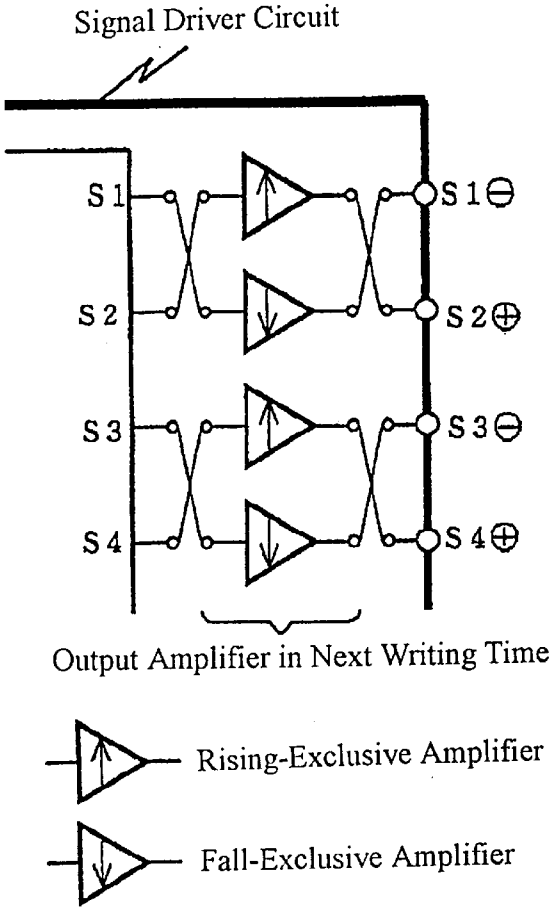

A first embodiment according to the present invention will be described. A novel active matrix liquid crystal display has a liquid crystal display panel 1 for displaying images. A signal line driver circuit 2 is provided for driving signal lines of the liquid crystal display panel 1. A scanning driver circuit 3 is provided for driving scanning lines of the liquid crystal display panel 1. A timing generator circuit 5 is provided which is connected to both the signal line driver circuit 2 and the scanning driver circuit 3 for supply control signals to both the signal line driver circuit 2 and the scanning driver circuit 3 respectively. The timing generator circuit 5 receives a vertical synchronizing signal "Vsync", a horizontal synchronizing signal "Hsync" and a dot clock signals "CLK" and generates various control signals. A data processing circuit 4 is further provided which is connected to the timing generator circuit 5 for fetching control signal. The data processing circuit 4 is also connected to the signal line driver circuit 2 and also adopted to receive data and process the received data for supplying the processed data to the signal line driver circuit 2 as the data interface.

Figure 9:
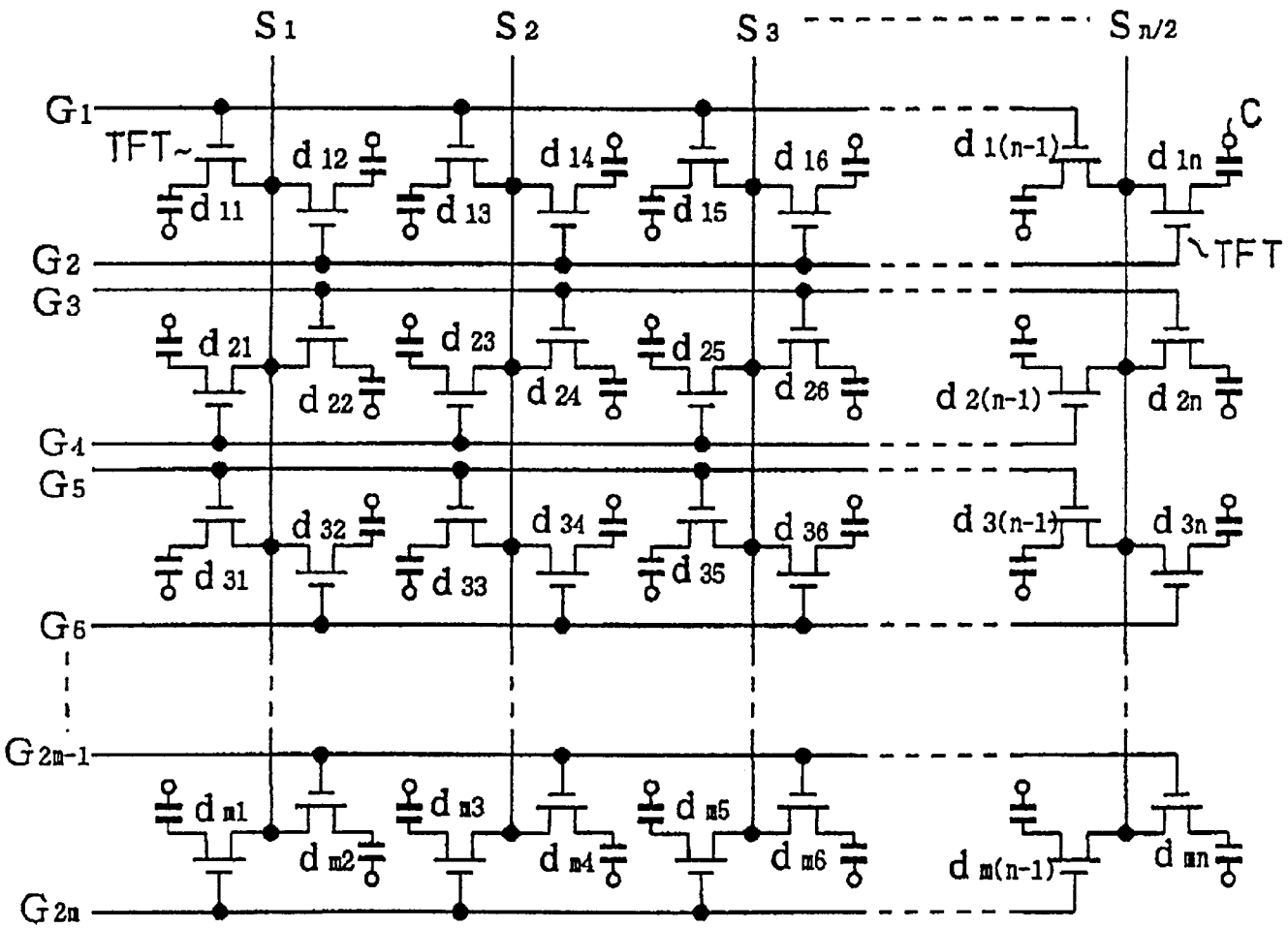
FIG. 9 is a circuit diagram illustrative of a novel active matrix liquid crystal display in a first embodiment according to the present invention.

FIG. 9 is a circuit diagram illustrative of the novel liquid crystal display. The adjacent two pixels commonly use the signal line extending between the adjacent two pixels. The pixel is connected through the thin film transistor into the signal line. For a single horizontal display line, two scanning lines are allocated. The thin film transistors are alternately connected through those gates to the different and adjacent scanning lines.

In accordance with the present invention, however, on the odd display line, gates of the thin film transistors connected to the odd pixels odd scanning lines whilst gates of the thin film transistors connected to the even pixels are connected to the even scanning lines. The odd and even display lines are opposite to each other in connections of the display lines and the switching elements.

Figure 10:
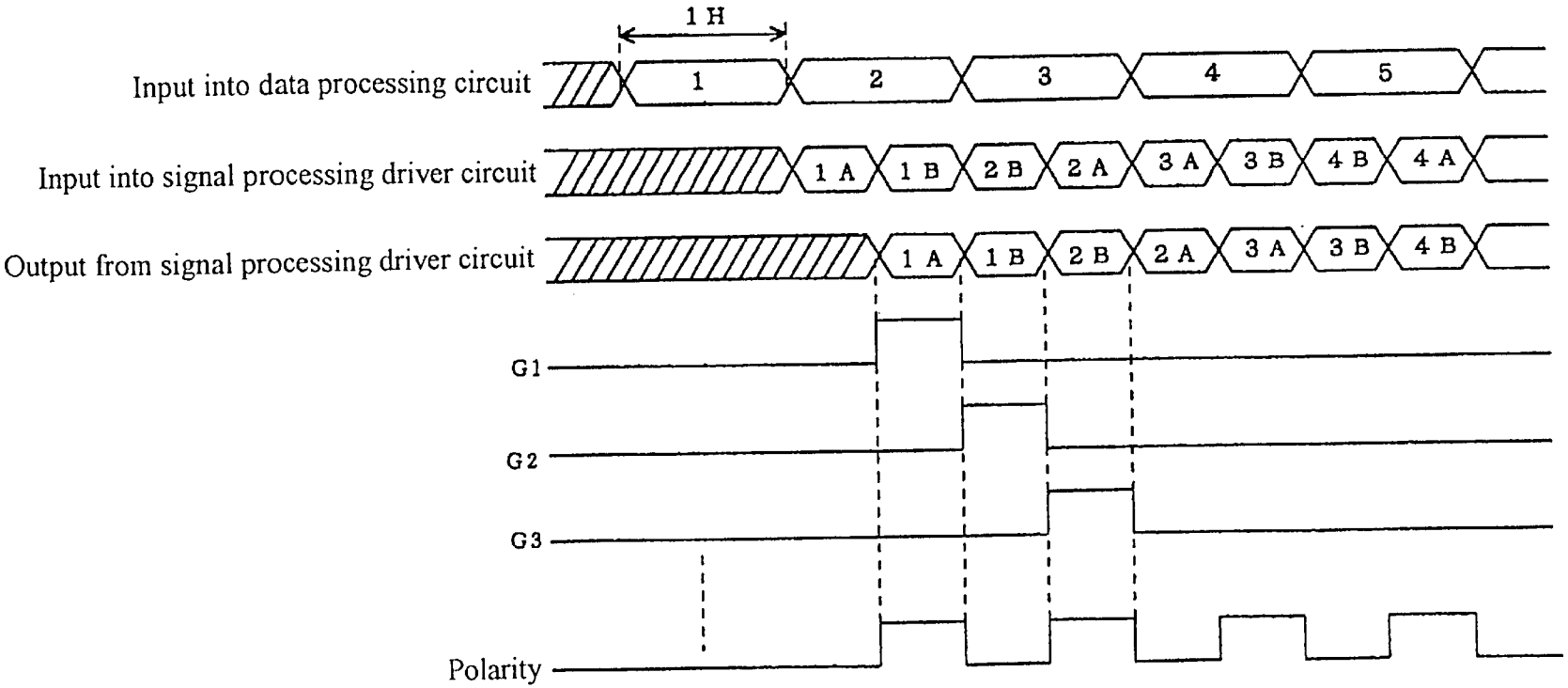
FIG. 10 is a timing chart of a novel active matrix liquid crystal display in a first embodiment according to the present invention.

FIG. 10 is a timing chart of the novel liquid crystal display. Data are inputted into the data processing circuits and are divided by the data processing circuits into odd and even data groups A and B so that data divided into the odd and even data groups A and B are output in a half horizontal period. The data processing circuits need line memories. In accordance with the output of the signal line driver circuit, the ON voltage of the thin film transistor is shifted over the scanning lines sequentially. The odd and even data are alternately written. The one time writing time-period is half of the normal one since the odd and even data are sequentially written.

By the way, adjacent two outputs are opposite in polarity to each other. If the output is inverted in polarity every time, then the polarity is changed for every two columns as illustrated in FIG. 11. If the negative and positive polarity writings are different from each other, then column stripes appear on the display. In order to settle this problem, it is effective to modify the signal or scanning line driver circuits. For example, all of the outputs from the signal line driver circuits have the same polarity and the polarity is inverted for every two outputs so that the dot inversion display screen illustrated in FIG. 11 can be obtained. If the adjacent two pairs of the pixels are considered to be unit, then the adjacent two units are opposite in polarity, notwithstanding, the polarity is almost complete inversion dots.

A second embodiment according to the present invention will be described. A novel active matrix liquid crystal display has a liquid crystal display panel 1 for displaying images. A signal line driver circuit 2 is provided for driving signal lines of the liquid crystal display panel 1. A scanning driver circuit 3 is provided for driving scanning lines of the liquid crystal display panel 1. A timing generator circuit 5 is provided which is connected to both the signal line driver circuit 2 and the scanning driver circuit 3 for supply control signals to both the signal line driver circuit 2 and the scanning driver circuit 3 respectively. The timing generator circuit 5 receives a vertical synchronizing signal "Vsync", a horizontal synchronizing signal "Hsync" and a dot clock signals "CLK" and generates various control signals. A data processing circuit 4 is further provided which is connected to the timing generator circuit 5 for fetching control signal. The data processing circuit 4 is also connected to the signal line driver circuit 2 and also adopted to receive data and process the received data for supplying the processed data to the signal line drive circuit 2 as the data interface.

Figure 12:
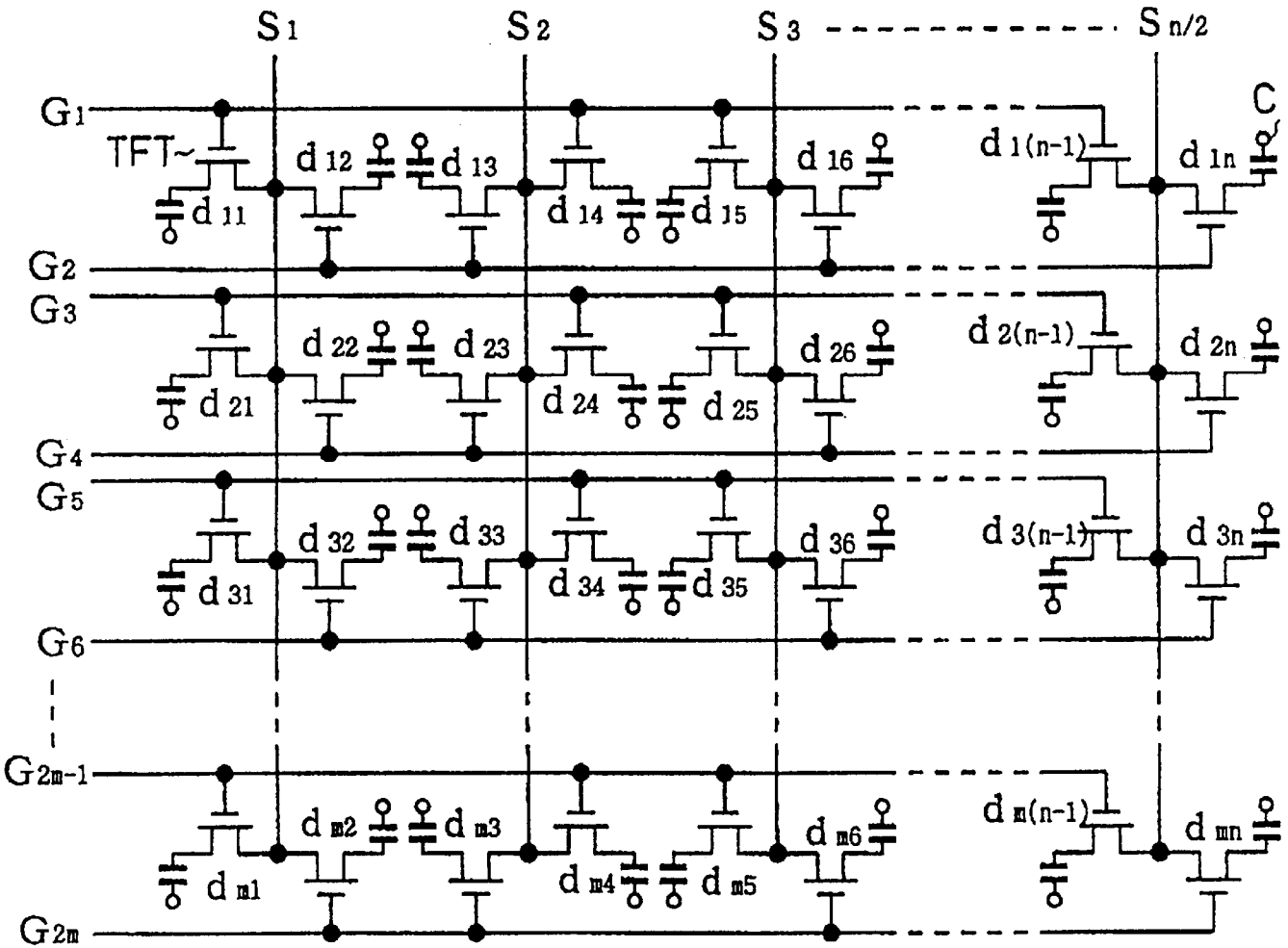
FIG. 12 is a circuit diagram illustrative of a novel active matrix liquid crystal display in a second embodiment according to the present invention.

FIG. 12 is a circuit diagram illustrative of the novel liquid crystal display. The adjacent two pixels commonly use the signal line extending between the adjacent two pixels. The pixel is connected through the thin film transistor into the signal line. For a single horizontal display line, two scanning lines are allocated. The thin film transistors are alternately connected through those gates to the different and adjacent scanning lines.

In accordance with the present invention, however, on the odd display line, gates of the thin film transistors connected to the odd pixels odd scanning lines whilst gates of the thin film transistors connected to the even pixels are connected to the even scanning lines. The odd and even display lines are opposite to each other in connections of the display lines and the switching elements.

Data are inputted into the data processing circuits and are divided by the data processing circuits into odd and even data groups A and B so that data divided into the odd and even data groups A and B are output in a half horizontal period. The data processing circuits need line memories. In accordance with the output of the signal line driver circuit, the, ON voltage of the thin film transistor is shifted over the scanning lines sequentially. The odd and even data are alternately written. The one time writing time-period is half of the normal one since the odd and even data are sequentially written.

By the way, adjacent two outputs are opposite in polarity to each other. If the output is inverted in polarity every time, then the polarity is changed for every two columns. If the negative and positive polarity writings are different from each other, then column stripes appear on the display. In order to settle this problem, it is effective to modify the signal or scanning line driver circuits For example, all of the outputs from the signal line driver circuits have the same polarity and the polarity is inverted for every two outputs so that the dot inversion display screen can be obtained. If the adjacent two pairs of the pixels are considered to be unit, then the adjacent two units are opposite in polarity. The polarity is complete inversion dots.

A third embodiment according to the present invention will be described. A novel active matrix liquid crystal display has a liquid crystal display panel 1 for displaying images. A signal line drive circuit 2 is provided for driving signal lines of the liquid crystal display panel 1. A scanning driver circuit 3 is provided for driving scanning lines of the liquid crystal display panel 1. A timing generator circuit 5 is provided which is connected to both the signal line driver circuit 2 and the scanning driver circuit 3 for supply control signals to both the signal line driver circuit 2 and the scanning driver circuit 3 respectively. The timing generator circuit 5 receives a vertical synchronizing signal "Vsync", a horizontal synchronizing signal "Hsync" and a dot clock signals "CLK" and generates various control signals. A data processing circuit 4 is further provided which is connected to the timing generator circuit 5 for fetching control signal. The data processing circuit 4 is also connected to the signal line driver circuit 2 and also adopted to receive data and process the received data for supplying the processed data to the signal line drive circuit 2 as the data interface.

Figure 13A:
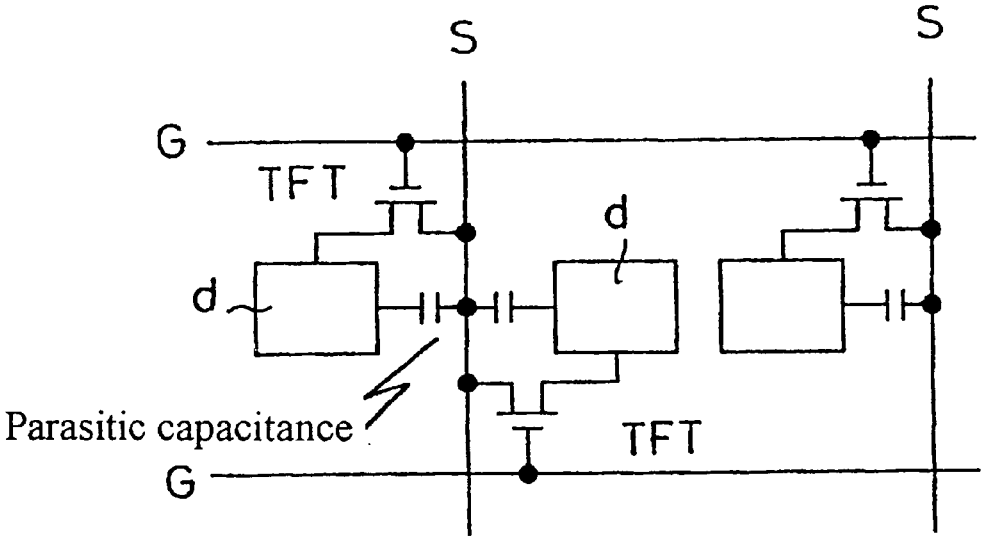
FIGS. 13A and 13B are a circuit diagram illustrative of pixels of a novel active matrix liquid crystal display in a second embodiment according to the present invention.
Figure 13B:
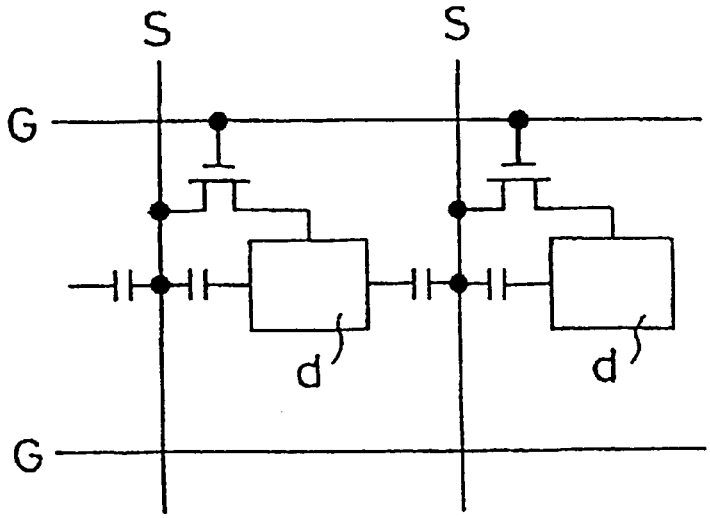

As illustrated in FIGS. 13A and 13B, parasitic capacitances are formed between the pixels and the signal lines. In the first and second embodiments, even the adjacent two pixels are connected to the single signal line, in operation any one of the pixels is electrically connected to the signal line. In this case, a parasitic capacitance is formed between the non-connected pixel and the signal line. In this third embodiment, however, the gates of the adjacent two thin film transistors are connected to the same scanning line so that the parasitic capacitance is symmetrically formed to prevent the friction of the potential of the common electrode.

Figure 14:
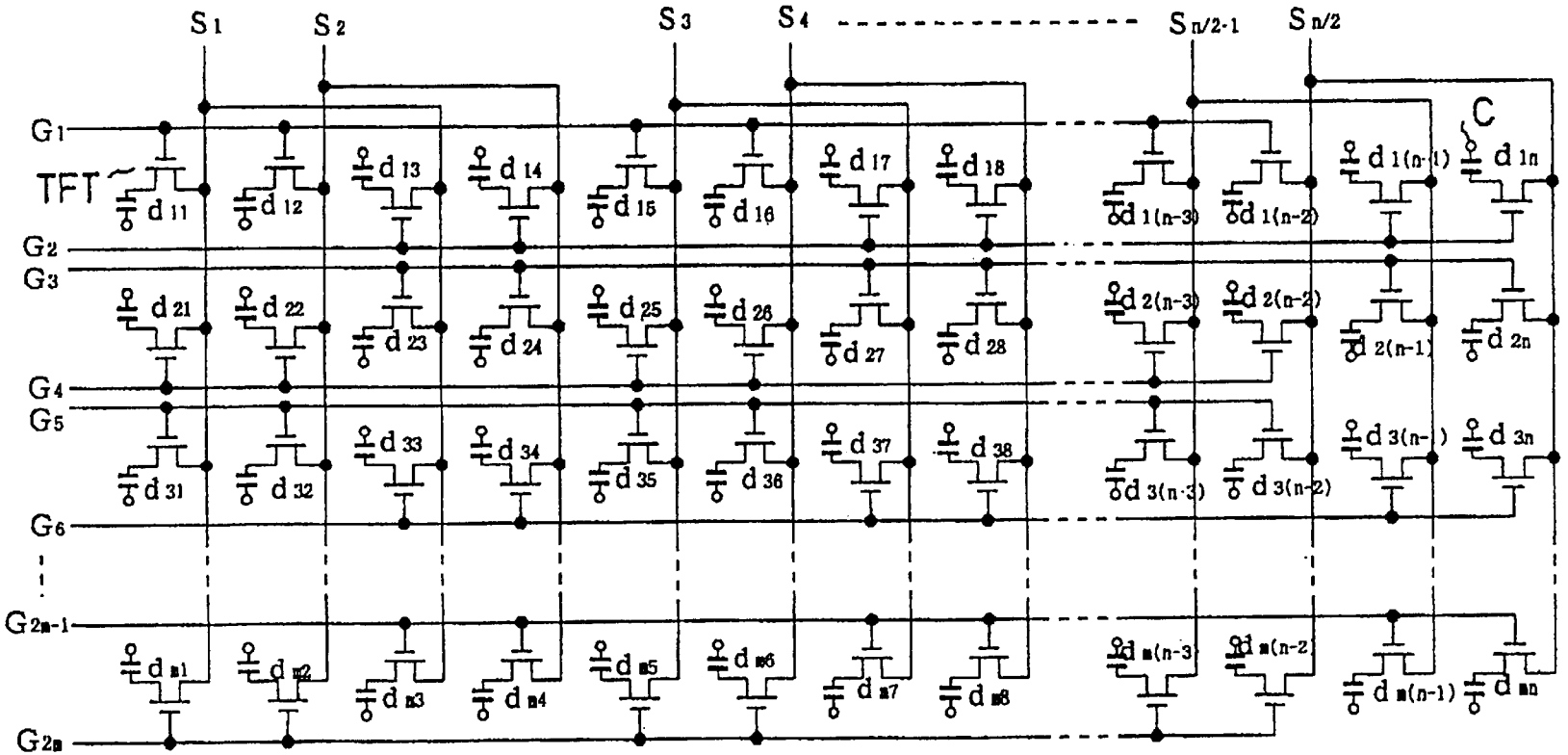
FIG. 14 is a circuit diagram illustrative of a novel active matrix liquid crystal display in a third embodiment according to the present invention.

FIG. 14 is a circuit diagram illustrative of the novel liquid crystal display. The adjacent two pixels commonly use a same scanning line Each pixel is connected through a thin film transistor into the signal line. For a single horizontal display line, two scanning lines are allocated. The thin film transistors are alternately connected through those gates to the different and adjacent scanning lines. The adjacent two odd signal lines are connected to each other and the adjacent two even signal lines are connected to each other.

In accordance with the present invention, however, on the odd display line gates of the thin film transistors connected to the odd pixels odd scanning lines whilst gates of the thin film transistors connected to the even pixels are connected to the even scanning lines. The odd and even display lines are opposite to each other in connections of the display lines and the switching elements.

Data are inputted into the data processing circuits and are divided by the data processing circuits into odd and even data groups A and B so that data divided into the odd and even data groups A and B are output in a half horizontal period. The data processing circuits need line memories. In accordance with the output of the signal line driver circuit, the ON voltage of the thin film transistor is shifted over the scanning lines sequentially. The odd and even data are alternately written. The one time writing time-period is half of the normal one since the odd and even data are sequentially written.

By the way, adjacent two outputs are opposite in polarity to each other. If the output is inverted in polarity every time, then the polarity is changed for every two columns. If the negative and positive polarity writings are different from each other, then column stripes appear on the display. In order to settle this problem, it is effective to modify the signal or scanning line driver circuits. For example, all of the outputs from the signal line driver circuits have the same polarity and the polarity is inverted for every two outputs so that the dot inversion display screen can be obtained. If the adjacent two pairs of the pixels are considered to be unit, then the adjacent two units are opposite in polarity. The polarity is almost complete inversion dots.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. An active matrix liquid crystal display, wherein adjacent two odd and even pixels are commonly connected to a single signal line, and two scanning lines are allocated to one horizontal display line, two switching elements of the adjacent two odd and even pixels are respectively connected to different ones of the two scanning lines and further the odd and even display lines are opposite to each other in connections of the display lines and the switching elements.

2. An active matrix liquid crystal display, wherein adjacent two odd and even pixels are commonly connected to a single signal line, and two scanning lines are allocated to one horizontal display line, for one signal line the switching elements of the odd display pixel are connected to one of the odd and even scanning lines whilst the switching elements of the odd display pixel are connected to one of the odd and even scanning lines and further the odd and even display lines are opposite to each other in connections of the display lines and the switching elements.

3. An active matrix liquid crystal display, comprising:

a predetermined number of odd signal lines connected to form a first group of odd display columns and a predetermined number of even signal lines equal to the predetermined number of odd signal lines connected to form a second group of even display columns, a pair of signal lines allocated to one horizontal display line, a switching element connected to a display pixel electrode and to one of the connected signal lines, wherein the odd and even display lines are opposite to each other in connection of the display lines and the switching elements.

* * * * *